US005228848A

United States Patent [19]

Kim

[11] Patent Number: 5,228,848

[45] Date of Patent: Jul. 20, 1993

[54] CIGARETTE LIGHTER WITH MESSAGE

[76] Inventor: Byung Y. Kim, 4313 Canoga Dr., Woodland Hills, Calif. 91364

[21] Appl. No.: 986,372

[22] Filed: Dec. 7, 1992

[51] Int. Cl.[5] ..... F23Q 1/02

[52] U.S. Cl. ..... 431/253

[58] Field of Search ..... 431/253, 254, 255, 276, 431/277

[56] References Cited

U.S. PATENT DOCUMENTS 4,311,448 1/1982 Strauss ..... 431/253

4,568,269 2/1986 Lin ..... 431/253

5,015,175 5/1991 Lee ..... 431/253

*Primary Examiner*—Carroll B. Dority

*Attorney, Agent, or Firm*—Jack C. Munro

[57] ABSTRACT

A cigarette lighter that discourages humans from smoking which is to emit a prerecorded message each time the cigarette lighter is activated. A typical prerecorded message would be to warn the user that smoking is hazardous to one's health. The prerecorded message can be changed if such is desired.

3 Claims, 1 Drawing Sheet

CIGARETTE LIGHTER WITH MESSAGE

BACKGROUND OF THE INVENTION

1. Field of the Invention

The field of this invention relates to igniting apparatuses and more particularly to a human hand held device for igniting a smoking material such as a cigarette, pipe or cigar and where a prerecorded message is emitted at the same time as the cigarette lighter is activated.

2. Description of Prior Art

A cigarette lighter defines a hand held, self contained, small, flame producing device that is used by humans that smoke. Although the lighter is defined as a cigarette lighter it is used to light cigarettes, cigars and pipes. Such cigarette lighters are in widespread usage and are sold to the general public at a relatively inexpensive price.

Smoking has long been deemed a habit which is to the detriment of the health of the partaker of the habit. In the past, there has been utilized a substantial number of different types of devices which are intended to help a smoker quit the smoking habit. One well known type of such a device is a warning label that is placed on every pack of cigarettes. One of the disadvantages to such a warning is that it is not read or stated to the smoker each and every time the smoker partakes of the smoking habit.

SUMMARY OF THE INVENTION

The primary objective of the present invention is to incorporate in conjunction with the cigarette lighter a recorded message that is played each time the cigarette lighter is activated with the message warning of the dangers of smoking.

Another objective of the present invention is to incorporate in conjunction with a cigarette lighter a message that can be changed so that the particular user is able to record a message that is particularly important to him or her to specifically help that individual stop the smoking habit.

Another objective of the present invention is to construct a device which can be manufactured relatively inexpensively and thereby sold to the ultimate consumer at an inexpensive price.

The structure of the present invention is directed to a hand held housing which includes an internal compartment within which is located a fuel source and an ignition device. The ignition device is to be activated by the user which will produce a flame exteriorly of the housing with this flame to then be utilized to ignite smoking material. Within the housing is also located a message recording and playback apparatus. A short message is to be prerecorded on this apparatus and when the cigarette lighter is activated to produce a flame, a recorded message is automatically played. The recorded message can be activated without activating of the cigarette lighter and the recorded message can also be changed by prerecording another message. This changing can be accomplished directly or by plugging into the message recording and playback apparatus a separate recording device.

DETAILED DESCRIPTION OF THE SHOWN EMBODIMENT

Figure 1:
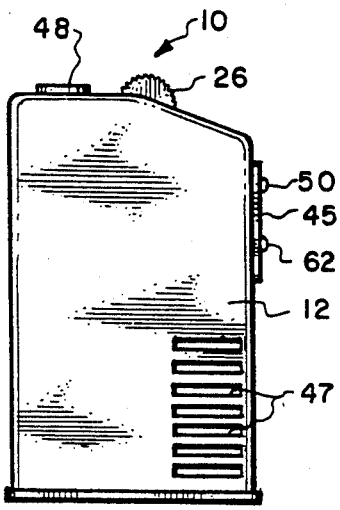
FIG. 1 is a front view of the cigarette lighter of the present invention.
Figure 2:
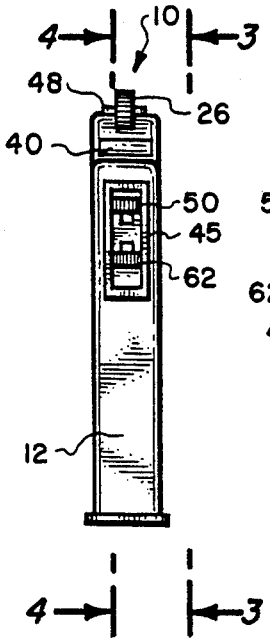
FIG. 2 is a right side view of the cigarette lighter of the present invention.
Figure 3:
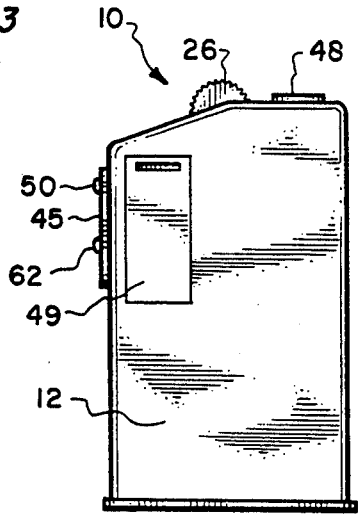
FIG. 3 is a back view of the cigarette lighter of the present invention taken along line 3—3 of FIG. 2.

Referring particularly to the drawing there is shown the cigarette lighter 10 of this invention which is constructed of a housing 12 which has an internal compartment 14. The housing 12 includes an opening 16 formed within the upper wall of the housing 12. Alongside the opening 16 is a second opening 18 formed within the housing 12.

Mounted within the internal compartment 14 in a fixed manner is a post 20. Mounted within the upper end of the post 20 is a support block 22. Mounted in the upper or outer end of the support block 22 is a flint pellet 24. This flint pellet 24 is in continuous contact with a spark wheel 26. This spark wheel 26 is pivotally mounted by means of a pivot pin 28 on the housing 12.

Figure 4:
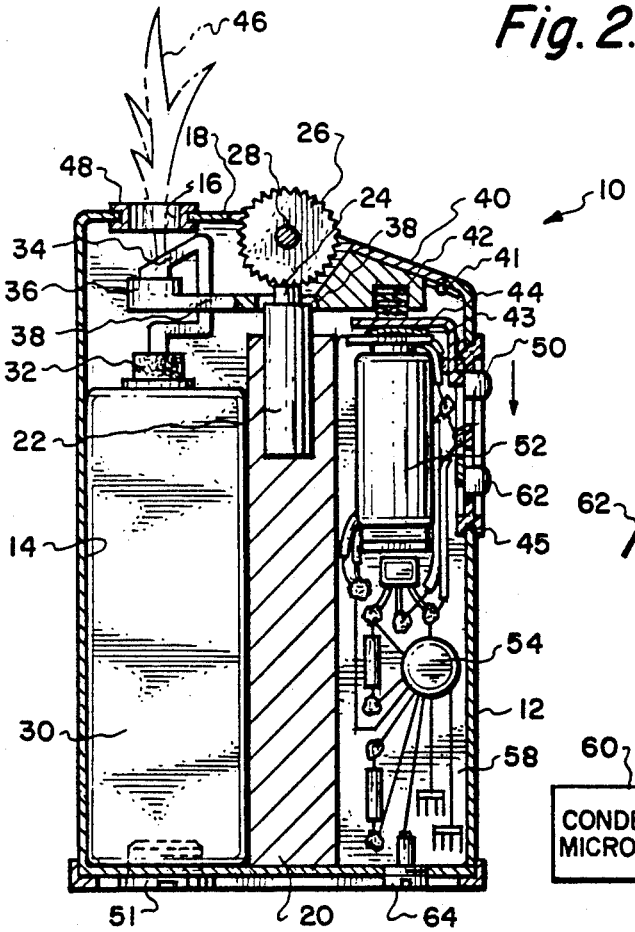
FIG. 4 is a cross-sectional view through the cigarette lighter of the present invention taken along line 4—4 of FIG. 2.
Figure 5:
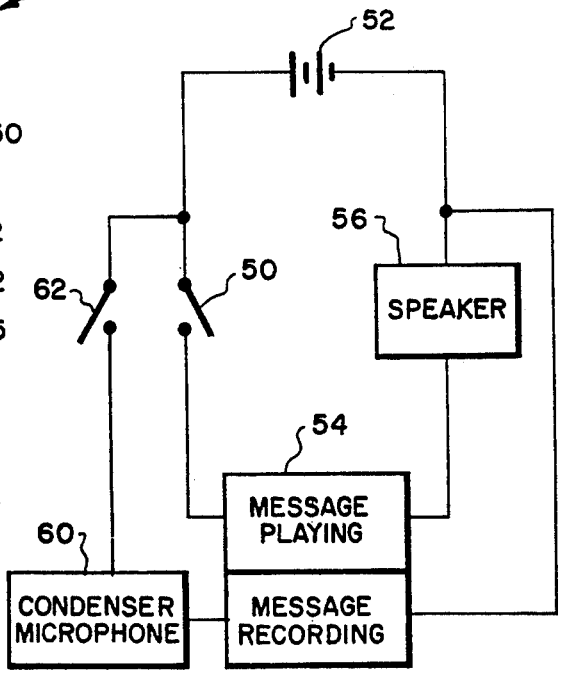
FIG. 5 is an electrical schematic of the message recording and playback apparatus incorporated within the cigarette lighter of the present invention.

To one side of the post 20 the internal compartment 14 includes an enlarged section within which is located a fuel supply container 30. Fuel supply container 30 is filled with fuel by removing bottom plug 51. This fuel supply container 30 has an outlet opening within which is mounted an outlet valve 32 through which a thin stream of fuel from the fuel supply container 30 is to be dispensed. This thin stream of fuel is to be conducted into a conduit 34 the outlet of which is normally closed by means of a pad 36. This pad 36 is fixedly secured to an arm 38, with this arm 38 being fixedly secured to a lever 40. This lever 40 is movably mounted by hinge 41 on the housing 12 with this movement being limited to a slight inward movement against the biasing action of coil spring 42 and spring 43. The inward surface of the coil spring 42 rests against a barrier plate 44 which is located within internal compartment 14. It is the function of the coil spring 42 to exert a continuous bias on the lever 40 tending to locate the lever into the position shown in FIG. 4. The barrier plate 44 is located to operate a switch 50. The spring 43 is located between barrier plate 44 and battery mounting plate 51. The barrier plate 44 moves a short distance in compressing spring 43 which is the distance required to move switch 50 from the off position to the on position.

In normal operation of the lighter 10 of this invention, the user manually rotates the wheel 26 which produces a spark from the flint pellet 24 in the direction of the valve 32. At the same time, the user presses downward on the lever 40 against the action of the coil spring 42 which causes the pad 36 to unseat and open the conduit 34 through which gas from the fuel supply container 30 is dispensed. This gas is flammable and is ignited by the spark which produces a flame 46 which is emitted through the hole 16 which is formed within bushing 48 which is fixedly mounted within the upper wall of the housing 12. It is to be understood that once the lever 40 is released, the spring 42 will return the lever 40 to its at rest position which in turn will cause the pad 36 to again come into contact with the open end of the conduit 34 and prevent the discharge of an fuel from the conduit 34 and hence extinguish the flame 46. Leaf spring 43 also moves barrier plate 44 to a spaced position from battery mounting plate 51.

When the lever 40 is pressed in a downward direction, the lever 40 moves switch 50 from a normally open position to a closed position. Closing of switch 50 causes electrical energy from a battery 52 to be supplied to the message playing section of a message recording and playback chip 54. Such chips are known as analog storage chips and are capable of emitting a short verbal message. One such chip is manufactured by Information Storage Device, Inc. of San Jose, California and carries part no. ISD 1016. Typical messages that can be played by the chip 54 would be "Please don't smoke", "Smoking is hazardous to your health", "Please, dear, stop smoking", "Daddy you have promised not to smoke" and so forth. The message 54 would be played from a speaker 56 which is incorporated in conjunction with the chip 54. When the lever 40 is released, the switch 50 will automatically move back to the open position. The battery 52 is to be changed through door 49 of housing 12.

The switch 50 is mounted on an exterior wall of the housing 12. The switch 50 is capable of being manually moved separately from the lever 40. This permits the user to hear a message without actually activating of the cigarette lighter 10. The mere fact of being able to hear the message can result in that particular individual not activating the lighter 10 and thereby not igniting a smoking material.

The chip 54 is mounted on a printed circuit board 58 which is located within the portion of the storage compartment 14 on the opposite side of the post 20 relative to the fuel supply container 30. Also incorporated in conjunction with the chip 54 is a message recording section which can be activated by speaking into a condenser microphone 60 through slots 47 in housing 12. In order to activate the microphone 60, a second switch 62 is to be moved from the open position to the closed position and this is to occur when switch 50 is in the open position. A short, individual message can be recorded through the microphone 60 when the switch 62 is closed. After the short message has been recorded, the switch 62 is released and is permitted to move back to the open position. This now recorded message can be played by closing of the switch 50. Switches 50 and 62 are mounted in switch plate 45 which is fixed to the housing 12.

A separate recorded message from a separate device can also be recorded on the chip 54. This is accomplished by plugging in of that device (not shown) into plug jack 64 which is mounted within the housing 12.

Although the use of a spark wheel is shown, it is considered to be within the scope of this invention that other ignition type of devices could be utilized. Such other types of ignition devices could be an electric ignition device or a piezoelectric ignition device.

Although the message playing and recording chip 54 is designed to replay a message of the human voice, it is considered to be within the scope of this invention that a non human voice messages could be utilized such as a computer generated voice if such is deemed to be preferred.

What is claimed is:

1. A cigarette lighter comprising:

said housing having an internal compartment, a fuel source contained within said compartment, igniting means mounted within said compartment, said igniting means to ignite a thin stream of fuel from said fuel source;

a depressable lever mounted on said housing, said lever when moved from an at rest position to a depressed position to operate an electrical first switch; and a message recording and playback apparatus mounted within said internal compartment, operation of said first switch causes a message to be played simultaneously with igniting of said thin stream of fuel.

2. The cigarette lighter as defined in Claim 1 wherein:

said first switch being manually operable separate from said lever, manual operation of said first switch separate from said lever results in the message to be played without igniting of said thin stream of fuel.

3. The cigarette lighter as defined in Claim 2 wherein:

a second switch being mounted on said housing, activation of said second switch permits a message to be recorded within said message recording and playback apparatus.

* * * * *